United States Patent [19]

Farrell

[11] Patent Number: 4,696,478

[45] Date of Patent: Sep. 29, 1987

[54] NEUTRAL ZONE, PIECE-CAPTURE GAME

[76] Inventor: Robert F. Farrell, 25 Churchill Rd., Quincy, Mass. 02169

[21] Appl. No.: 794,051

[22] Filed: Nov. 1, 1985

[51] Int. Cl.[4] ..... A63F 3/00

[52] U.S. Cl. ..... 273/261

[58] Field of Search ..... 273/260, 261, 262, 242, 273/258, 263, 264; D21/24

[56] References Cited

U.S. PATENT DOCUMENTS

| | | | |
|---|---|---|---|
| D. 52,394 | 9/1918 | Heylmann | D21/24 |
| 386,007 | 7/1888 | Gibford | 273/261 |
| 1,392,979 | 10/1921 | Taufer | 273/260 |
| 1,400,520 | 12/1921 | Bugenhagen | 273/260 |
| 1,772,583 | 8/1930 | Barrett | 273/260 |
| 3,844,563 | 10/1974 | Isaac | 273/260 |
| 3,897,953 | 8/1975 | Hovnanian | 273/260 |
| 4,067,578 | 1/1978 | Chang | 273/261 |
| 4,200,293 | 4/1980 | Benson | 273/262 |

FOREIGN PATENT DOCUMENTS

| | | | |
|---|---|---|---|
| 873035 | 6/1942 | France | 273/261 |
| 7593 | of 1902 | United Kingdom | 273/262 |
| 25962 | of 1908 | United Kingdom | 273/261 |

*Primary Examiner*—Anton O. Oechsle
*Assistant Examiner*—Matthew L. Schneider
*Attorney, Agent, or Firm*—Robert K. Tendler

[57] ABSTRACT

A neutral or a demilitarized zone (DMZ) is provided for a matrix-type "detente" piece-capture board game in which only one piece at a time can occupy a given square or point, with the neutral zone providing a safe haven for all elements utilized in playing the game. The neutral zone can take the form of an offset cruciform arrangement of spaces or a square outline of spaces. The neutral zone can be differentiated from the other spaces on the board by color differentiating the spaces within and outside the zone. Alternatively, the neutral zone can be differentiated by a line that circumscribes the zone.

2 Claims, 14 Drawing Figures

NEUTRAL ZONE, PIECE-CAPTURE GAME

FIELD OF INVENTION

This invention relates to piece-capture board games in which pieces are captured and, more particularly, to a matrix-type board and a board configuration which defines a neutral zone for the protection of pieces which adds a degree of complexity to the game as well as an additional opportunity to provide for a negotiated detente.

BACKGROUND OF THE INVENTION

As can be seen by U.S. Pat. Nos. 534,080; 809,502; U.S. Pat. No. Des. 55,455; U.S. Pat. Nos. 2,614,842; 2,756,053 and 4,147,360, four-person chess and checker boards have been created upon which more than two people can play a variation of either chess or checkers. With respect to these games, it will be noted that none of the squares are specialized in that none of the squares are designated as having any quality other than the quality of a traditional square of a given color (e.g., light or dark). That is to say, there is no quality of variant game squares which alters traditional game play. For example, in traditional chess, a knight may take a pawn at any position on the board, and this is also the case where a checker piece of one party can take the checker piece of another party in any legal position on the board. Ability to take pieces at any position on the board is central to game play. Other game patents of interest are U.S. Pat. Nos. 3,604,709; 3,820,791; 3,995,704 and 4,256,309.

While "war games" have been popular for many centuries, the degree of adversarial content varies significantly, as does the nature of play permitted. On the other hand, there have been few games, if any, in which the objective of the game is to offer cooperation among those players who have been in an initial adversarial relationship. This is a relatively new development which springs from nuclear scenarios.

It will be appreciated, at least in chess, that a stalemate occurs when no move is available except one that results in check for a king when the king to move was not previously in check, when insufficient power remains to effect checkmate, or when both players agree that continued play will result in stalemate. Indeed, there are some chess masters who prefer to play to a stalemate in certain situations as opposed to trying to win, either for psychological advantage or because of a potential losing situation.

However, stalemate is viewed as a lost cause as opposed to an outright loss. It is a consequence second to frustrated victory but preferred over certain defeat. Detente, in contrast, can be appreciated as an alternative to either victory or defeat and sought as a condition in its own right. It is not necessarily an outcome of contest, but it is a preferred alternative to the results of war.

It is, therefore, an object of the subject invention to provide a unique board configuration which permits a detente or an agreed-upon situation as an alternative to defeat, victory or stalemate while, at the same time, increasing the level of sophistication and complexity of the game.

Moreover, a unique game board configuration is provided by a multi-person checker- or chess-like board upon which players may band together or consult in order to work their way out of a conflict situation.

Their choices include alliances, individual supremacy, continued conflict and detente. It is a unique and timely game to impress modern conditions upon players. Very simply, it is a game that embodies modern political concepts in its structure. Never before have games tried to embody detente, quite simply because the concept did not exist as a political reality at the time of their creation.

SUMMARY OF THE INVENTION

In detente, a piece-capture, matrix-type board game, a neutral zone is delineated in which more than one piece cannot occupy a square or point and in which pieces cannot be taken while they remain within the neutral zone.

The neutral zone can be delineated by circumscribing a line around the zone or by color differentiating the spaces within the zone from the spaces outside the zone. The neutral zone can be shaped in one of numerous shapes. Specifically, the neutral zone can be an arrangement of spaces set forth in an offset cruciform shape. Alternatively, the spaces of the neutral zone can be arranged in a plurality of spaced squares or in a single square surrounding a central area. The matrix-type board upon which the neutral zone is delineated can be a cruciform arrangement of spaces. The inner angles of the extending arms that define the cruciform can have indicia thereon so as to indicate that movement across the inner angle is precluded.

However, even if a consequence of use is not specified, the basic function of a neutral zone is unique. Even a rule permitting violence within the neutral zone could be made. Neither would alter the concept of a neutral zone but would simply be a rule determining consequence of use. Unique, however, is the physical use based upon the physical fact that no two things can occupy the same space at the same time. Unlike Parcheesi and similar models, no two pieces can occupy the same square at the same time. There is no common safe space in detente, and actual piece movement is affected by this.

As part of the rules for the game provided by the unique layout of the board, the first move out of the neutral zone cannot result in capture. What this means is that in order to come out of the neutral zone, the player moving his piece out of the zone forfeits a capture-type move.

In the case of checkers, a capture can be made while moving into the neutral or dead zone, although no capture can be made by a checker piece coming out of the neutral zone.

For the four-person chess/checker boards such as those depicted, the advantages of a neutral zone or zones are both social and military in that the number of players makes detente more difficult to accomplish. There are more variables, and therefore, more possibilities of alliances.

To distinguish the subject board game from other board games, it will be appreciated that Chinese checkers is not a capture game. Moreover, in Parcheesi, numbers of pieces can occupy a space, as can pieces in Monopoly. Such is not the case here. It will, however, be appreciated that the present concept can, for instance, extend to the ancient game of GO. Thus, configuration of the neutral zone depends on the game, with chess as one example requiring a configuration that permits movement of the knight, although this is not essential.

In summary, a unique matrix-type board configuration is provided such that a neutral zone is delineated, with a penalty for the use of the neutral zone being that a piece cannot capture another piece on its way out of the neutral zone. The neutral zone, in general, can be made up of squares of a different set of colors than the rest of the squares on the board. However, in one embodiment, the light/dark definitions correspond to the rest of the board, and all pieces must respect this light-/dark definition. In one case, the neutral zone is defined by outlining which, of course, preserves the light/dark scheme.

CHESS

A piece or pawn cannot capture from the DMZ. Thus, it must move outside the zone in its normal fashion. Then, it can exert its defined powers. As can be seen, the board indicia interact with the game to provide new rules which redefine the game such that a piece might both lose its power within the neutral zone and be neutralized so that the piece or pawn cannot immediately capture as part of its exit move. Therefore, a piece or pawn can move through the zone only if the move does not result in a capture.

It is a feature of the subject game, made possible by the subject board, that no piece or pawn can be forced from the neutral zone, and no other piece or pawn can share its space. For example, if the only move left to an army is to move a piece or pawn from the neutral zone, that army can "pass" on its turn and do nothing. Thus, the board configuration provides for the possibility of a new rule. The structure of the board, in contributing to a "pass" situation, can facilitate agreement between players to a negotiated settlement i.e., detente. These decisions are made via a strategy which indicates to the players that an attempt at winning with the situation at hand is not preferred and that a detente or coexistence is preferable. Thus, the game can be played with a view to teaching the circumstances under which detente is desirable.

CHECKERS

With respect to checkers, the neutral zone exists in a predetermined location on the detente board. This zone is made up of a number of squares of different sets of colors or delineated in some fashion. As before, the light/dark definition corresponds to the light/dark definitions for the squares of the rest of the board. The neutral zone is again defined as one wherein no checker may be captured and the defined spaces cannot be shared.

A regular checker or a king cannot capture from the neutral zone. It must move outside the zone to resume its normal function. Then, it can exert its defined powers.

As before, movement through the neutral zone removes the power of a checker to capture another. Therefore, a checker may move through the zone only if the exit move does not result in a capture. However, a checker piece or king can jump another on its way into the neutral zone.

As in chess, no checker or king may be forced from the neutral zone. For example, if the only move left to an army is to move from the neutral zone, that army can "pass" on its turn and do nothing. Thus, as in chess, the subject board permits negotiations for detente.

While the subject invention will be described in terms of chess or checker moves, the method of play established by the neutral zone is applicable to many matrix board games. Moreover, in a cruciform board embodiment, a rule which prevents diagonal movement across the inner cruciform corners adds another dimension of complexity to play.

In summary, unlike any other matrix piece-capture game, at least one neutral or demilitarized zone is provided in which powers of the piece are altered or suspended. Moreover, in one embodiment for play by more than two people, the passage of remaining pieces to the party capturing the king of those pieces adds another element of complexity and intrigue. Hence, the size of one's army can be greatly increased by the capture of another's king, even that of an ally. The neutral zone idea establishes a link between the board indicia and the new rules made possible by the board indicia. The cruciform makes possible a non-cross rule at an inside corner and the possibility of a piece going "astray," which adds complexity to the end game.

BRIEF DESCRIPTION OF THE DRAWINGS

These and other features of the subject invention will be better understood in connection with the Detailed Description taken in conjunction with the drawings of which.

DETAILED DESCRIPTION

Figure 1A:
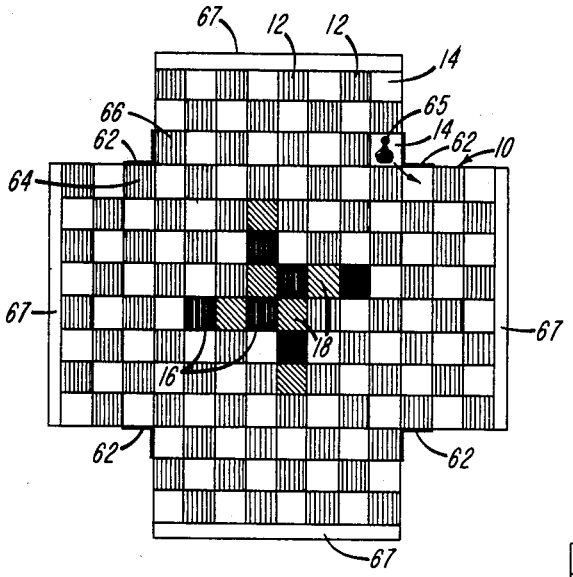
FIGS. 1A and 1B illustrate one embodiment of the neutral or DMZ zone for a cruciform board, illustrating respectively a change in color to define the neutral area and a delineation via an exterior circumferential line to define the neutral zone.
Figure 1B:
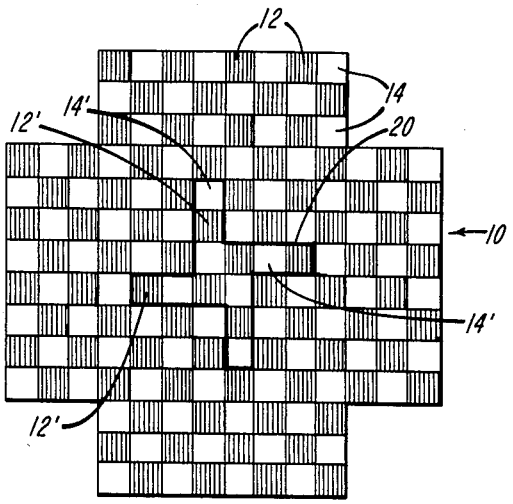

Referring now to FIGS. 1A and 1B, it will be appreciated that in FIG. 1A the neutral zone is defined by light and dark squares having light/dark alternating shadings corresponding to that of the rest of the board. In this embodiment, the neutral zone is an offset cruciform in which the arms of the cross are offset by one line of squares. As illustrated, the board may have black and white squares, whereas the neutral zone may have blue and grey squares. The board is generally indicated by reference character 10 to be a cruciform board having black squares 12 and white squares 14 with the neutral zone being indicated by blue squares 16 and grey squares 18.

As can be seen from this configuration, were a game of chess to be played on this board, a knight could move within the neutral zone so that he could position himself to advantage without leaving the zone.

Referring to FIG. 1B, black squares 12 and white squares 14 are as in the FIG. 1A embodiment. It will be noted that black squares 12' within the neutral zone designated by outline 20 are of the same color as that of black squares 12, whereas white squares 14' are of the same color as those corresponding zones outside the neutral zone. It will therefore be appreciated that the neutral zone may either be delineated by a change in color, with a like light/dark characteristic, or may be delineated by a circumferential line around the neutral zone.

While the subject invention will be described in terms of a chess/checker board configuration, it will be appreciated that other types of board games, such as GO, which result in the capture of pieces, are included within the scope of this invention, should they include a neutral zone. Thus, for instance, in GO, a neutral zone may be added simply by drawing a line on the GO board which surrounds a given area. With respect to GO and some other matrix board games, the neutral zone need not be rectilinear in configuration.

Referring to FIGS. 2–8, the shading of the board is left open with only the shading of the neutral zone being delineated. With respect to FIG. 2, the neutral zone is illustrated as being surrounded by line 22, which defines a cruciform in which opposite arms are offset by one line of squares and in which a square is added to the same side of each arm, the added square being adjacent a central four-square block. As will be appreciated, this neutral zone provides, in the game of chess, for free movement of the knight in certain directions, with the opportunity to remain within the neutral zone during those moves.

Figure 2:
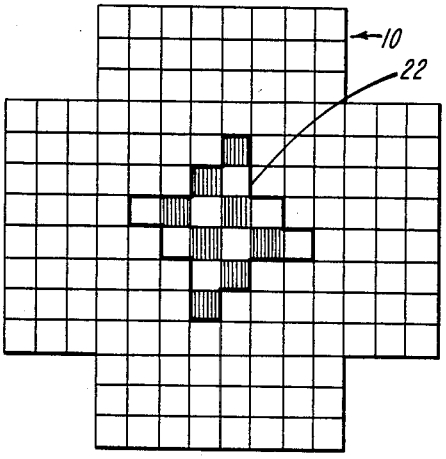
FIGS. 2–8 illustrate respectively different neutral zone configurations, with FIGS. 2, 3 and 4 indicating a neutral zone generally centrally located, with FIG. 5 indicating a plurality of neutral zones adjacent the four respective playing areas, with FIG. 6 indicating a neutral zone with a regular playing zone contained within the neutral zone, with FIG. 7 having a diagonally configured neutral zone, and with FIG. 8 having an offset cruciform neutral zone.

Other reasons for the configuration of the neutral zone in FIG. 2 are as follows: The actual size is increased and provides for more pieces to enter and remain there; the necessity of passing through it is increased, and therefore, a greater pacification penalty is imposed upon players; there is a greater balance between war and detente zones, thereby increasing the reality of a detente option upon the board.

Figure 3:
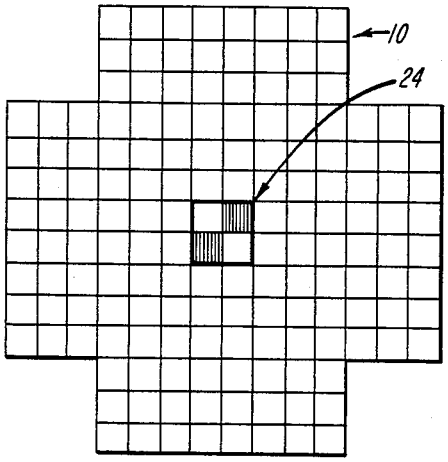

With respect to FIG. 3, a neutral zone may include only four squares as illustrated by the squares surrounded by line 24, with the neutral zone being very small indeed and providing only slight haven for the pieces contained therein. It will be appreciated that with respect to the game of chess, a knight, when landing in the zone, is not free to move about.

Other reasons for such a small zone are as follows: It is an assumed political fact that very few safe havens exist within a conflict-ridden territory and have very little effect upon international conflict and schemes. Moreover, the small size of a neutral space increases its value since less of it is available. Additionally, sizes, especially those small and valuable, change the tactical and strategic game with a small space interfering less in general conflict but figuring more urgently in protection afforded.

Figure 4:
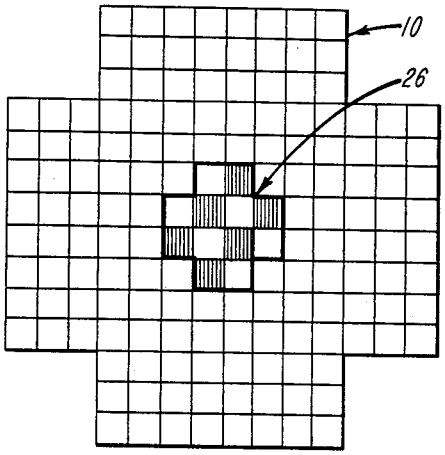

Referring now to FIG. 4, a central cruciform neutral zone with each arm of two-square width, as illustrated by line 26, is centrally positioned in the cruciform board 10 which has the following attributes or characteristics for the game:

Again, it is a size and placement variation but does not alter the basic concept. It is offered as an example of how the neutral zone's definitive configuration can vary but whose variance does not alter the concept embodied in the board by its presence.

Figure 5:
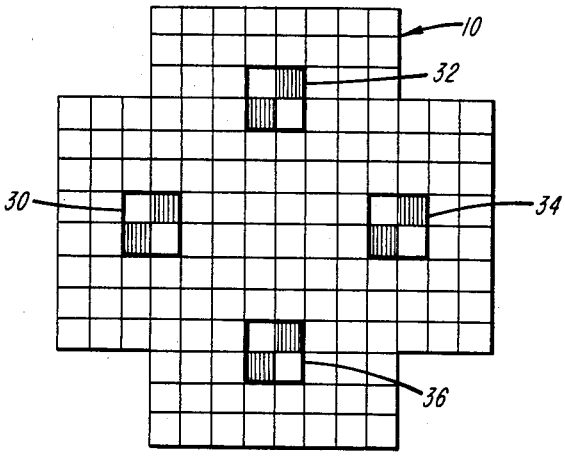

Referring to FIG. 5, multiple square neutral zones designated by lines 30, 32, 34 and 36 are illustrated on board 10 to provide protection in an least four different areas, for instance, adjacent four armies, with the advantage that armies having valuable pieces may protect them initially in the opening game since the particular piece need not have far to go. Also, this configuration affects the end game in that high valued pieces may be placed fairly close to high valued pieces of an opponent and remain safe at least until they are removed from the neutral zone. Other reasons for the multiple neutral zone configuration are as follows:

A sense of ownership is engendered when a safe haven is established quite close to amassed strength. It is close and offers quick access with low risk. Conversely, a sense of extreme danger is created when hostile forces can exist in a safe haven close to one's own territory and power; witness the placement of various missiles. An element of play in detente is quite clearly a weapon, and its safe residence in a neutral zone close to one's own amassed power is sensed as offensive. Quite reasonably, an urge to protect one's own or close neutral zone and remain in possession of it is created. This corresponds to an international pattern to surround oneself with friendly nations or to define territorial zones at sea. The necessity to control neutral zones close to oneself and to control them in general is highlighted by more than one zone with a defined proximity and apparent distance values. Indeed, the entire game of detente might be construed to revolve about the military uses of the neutral zone.

Figure 6:
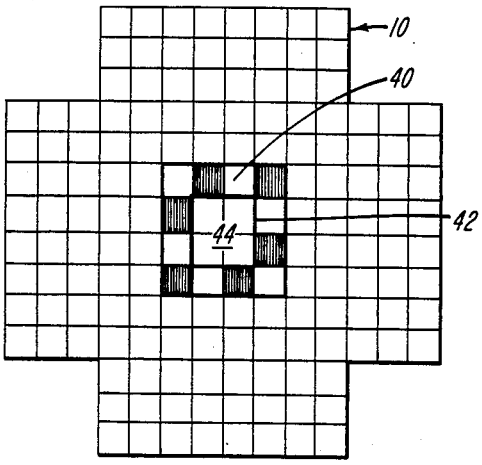

Referring now to FIG. 6, it will be appreciated that a neutral zone may be delineated by lines 40 and 42 to include a ring of squares having an internal section designated generally by reference character 44 which is a non-neutral or regular-play zone. This again adds a different dimension of complexity to the particular game played and is useful in making a configuration more interesting because there is a tactical effect upon any piece choosing to use space 44 as well as effects upon any element of play which must pass through the neutral zone surrounding it. These effects have been described, but there is a further effect. The enclosed non-neutral zone is different from the rest of the non-neutral zones since, by necessity, all must pass through the neutral zone to enter it, and thereby, have their consequent powers altered. It is a defined non-neutral zone which is always influenced directly by the neutral zone area around it.

Such areas are a geopolitical reality, best represented by partitioned Berlin or Hong Kong. Again, as the neutral zone is a vital element in the structure of a detente board, it assumes the geopolitical and military aspects of modern reality. Its presence matters more than its particular morphology simply because its size and shape, even with a finite matrix such as the detente cruciform board of 160 squares, approach the infinite.

Figure 7:
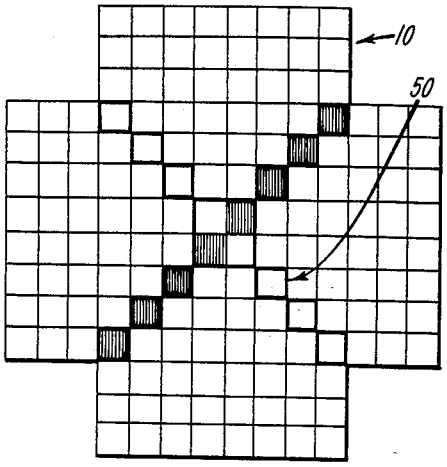
Figure 8:
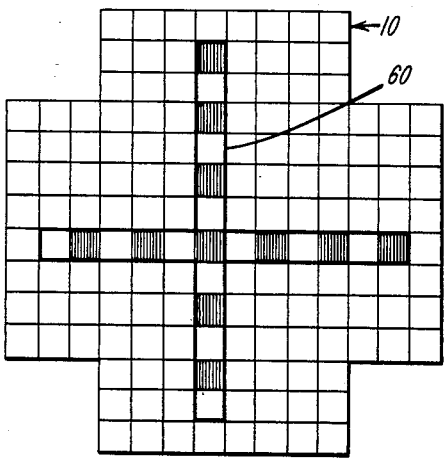

Referring now to FIG. 7, a diagonal neutral zone configuration is illustrated as having a central four-square region and individual squares on diagonals which run from opposite inner corners of the cruciform board. The advantage, at least in chess, is that with respect to bishops and certain other pieces, moves may be protected so that the bishops, queens or kings can move in the neutral zone, whereas knights may not do so.

It has been demonstrated that any neutral zone configuration inevitably affects detente, its strategy and the geopolitical realities of play. These various illustrations support the contention that while specific configurations of a neutral zone are best represented by a factorial, the basic concept, unique to detente board structure is always the same. The neutral zone, as structured into a detente board and controlled by that structure, embodies modern geopolitical concepts and affects the variety of human interchange via detente. Various zones can be constructed that alter access of certain elements of play for each force and therefore appear unfair as in FIG. 8, an offset cruciform neutral zone, illustrated by line 60, which has two adjacent arms longer than the other adjacent arms. This configuration is useful in providing a degree of variation among forces. That variation alters the initial impact among forces and is therefore probably not fair.

In all the above embodiments, a cruciform board 10 has been illustrated. Because it is a cruciform board, players numbering over two may play the game, and therefore, increased complexity results. The neutral zone may be utilized in two, three or four person chess/checker situations or even other matrix piece-capture games.

Referring again to FIG. 1A, the board may be provided with heavy lines, 62, at the interior corners or angles of the cruciform board which will indicate that movement diagonally across this corner is prohibited. Thus, a bishop cannot move from square 64 to square 66 in a chess game; nor can a pawn, since such a move results in a situation in which pawns can traverse a prohibited area, i.e., that area not considered part of the playing surface. Thus, the pawn is said to be "astray." This, indeed, adds a further element of complexity to the game of chess and, in fact, can be applied to checkers and other games as well.

METHODS OF PLAY

As mentioned hereinbefore, the neutral zone is one in which, once a piece is in the zone, it loses its power to effect capture during that time and for one move thereafter, and at the same time, it is protected. It is a feature of the detente board neutral zone that, regardless of the elements of play and their defined moves, a rule is specified that one element of play cannot capture another until the capturing element has moved out of the neutral zone. The move following the exit move can be a capture move. Moreover, the neutral zone provides a rule for permitting the army to move to pass if the only move remaining to that army is to remove an element of play from the neutral zone, thereby providing an additional vehicle for the parties to agree as to detente. A pass may also be claimed by a force if the only move remaining would result in a king's capture.

Another feature of the subject game is that once, for instance in chess, a king of one party has been captured, the remaining pieces associated therewith then belong to the capturing party.

As mentioned hereinbefore, with respect to checkers, a piece can capture a piece when moving into the neutral zone but may not capture a piece when coming out of the neutral zone.

CHESS

In one embodiment, when chess pieces are used, the following rules apply. Four armies are arranged upon the board, with the pieces being White, Silver, Black and Gold in one embodiment. Each army consists of one king, one queen, two rooks, two knights, two bishops and eight pawns. Each army is set up as in classical chess in the area directly opposite its matching color band 67 in FIG. 1A. Therefore, the White army of the North is set up in the Black area of the South; the Silver army of the East is set up in the Gold area of the West; the Black army of the South in the White area of the North; and the Gold army of the West is set up in the Silver area of the East.

For a pawn to reach its queening rank, it must travel across fourteen ranks to those squares next to its matching color band. A White pawn, for example, begins its advance from the Black area. It must proceed northward until it reaches the queening squares of the North or the rank of squares next to the White band.

Figure 9:
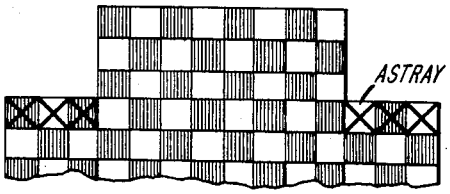
FIG. 9 is a diagram of a portion of a cruciform board illustrating the "astray" pieces.

As illustrated in FIG. 9, there are events which occur because of the unique shape of the detente board. A pawn moving toward its queening squares might capture to the northeast or northwest and find itself at a boundary of the detente field but three ranks from its own queening squares.

If a White pawn, proceeding toward its queening squares, comes to rest upon any of the above squares marked with an "X," it cannot move forward or capture diagnonally without passing off the board or going around a corner. The pawn is unable to continue its movement and has gone "astray." While it cannot move, it does have a value. It can provide cover and must be considered in tactical moves within its vicinity. In another circumstance, with only kings remaining on the board in addition to a pawn that has gone "astray," the king to which the pawn belongs commands superior power. Therefore, detente is impossible until the pawn is captured since detente is an actual condition of equal power.

Figure 10:
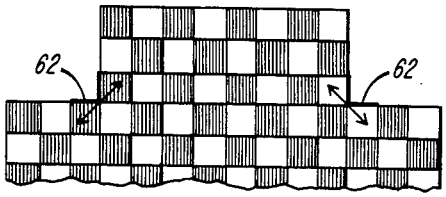
FIG. 10 illustrates a section of the cruciform board of FIG. 1A, illustrating prohibited diagonal moves.

As illustrated in FIG. 10, the unique shape of the detente board places certain restraints upon any piece which moves on a diagonal. The corners created by the areas appear to offer a diagonal path. It is ruled that they do not, and this may be delineated by lines 62 as in FIG. 1A. Therefore, the following moves are not permitted for pawns, bishops, queens or kings; any diagonal move across areas indicated by line 62.

Figure 11A:
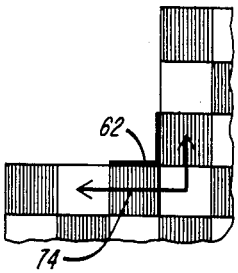
FIGS. 11A and 11B illustrate a section of corner 62 of FIG. 10 showing that a knight can maneuver the prohibited corner.
Figure 11B:
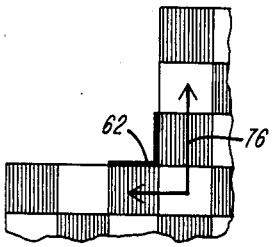

As illustrated in FIGS. 11A and 11B, for a pawn or a piece to move through that area, part of it would pass off the board. A knight, however, can negotiate the corner because it can make the moves around corner 62 as illustrated by arrows 74 and 76.

The most important event in detente concerns the king. It can be captured just as any other piece or pawn. A king cannot capture another king, however. Just as in classical chess, one king cannot approach another without checking itself. There is a position that appears to contradict this statement. An illustration follows.

Figure 12:
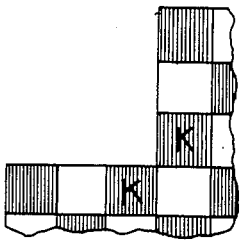
FIG. 12 is an illustration of a part of the board of FIG. 10 illustrating play for a king in capturing another king.

Referring now to FIG. 12, a diagonal is defined as a line formed when four squares meet at one point. The unique shape of the board creates a corner where three squares meet. The situation is akin to each standing on a side of a building facing a corner. Neither can do each other harm as long as they do not proceed past the corner.

When a king is captured, all remaining pieces and pawns of his army become mercenaries in the capturing king's army. The defeated king is removed from the board. When a king is captured, the capturing power assumes the conquered power's turn to move in the sequence established. So, a White king captured by a Black piece takes two turns to move his combined army.

The illustrated board game may be played by four people who, prior to the selection of forces, agree to play as two teams or as individuals. If the choice is to play as individuals, each person rolls a pair of dice and totals the number appearing on them. The person with the highest number chooses his power first. The person with the second highest number chooses next, and so on. If a tie occurs, persons with the tied scores roll again.

Team play is slightly different. One person from each team rolls the dice. The highest score chooses first. However, team members must occupy opposite ends of the board. Therefore, if a person chooses White, his partner must play Black. If one partner chooses Silver, the other must take Gold. This is done so that, in the beginning, two moves cannot be made in succession against the opposing forces. The agreement to play as a team is null and void if one team partner captures the other's king.

In individual play, a captured force is moved by the capturing power; and so it is in team play. Only the capturing power can move captured pieces or pawns. The move will benefit the team, but only the capturing power may effect the move.

Actual play is begun by the person who rolled the highest sum. It continues in a counter-clockwise direction until the game is resolved. No turn may be skipped as long as there is a possible move remaining. There is no stalement. If there is no move possible which does not force the power to move pieces from the neutral zone or does not result in capture of his king, his turn is passed, and play continues.

CHECKERS

When checker pieces are used, the following rules apply; Four armies are arranged upon the board; in one embodiment, a Black army, a White army, a Silver and a Gold. Each army consists of twelve pieces set up as in classical checkers in the area directly opposite its color band. Therefore, the White army of the North is set up in the Black area of the South. The Gold army of the West is set up in the Silver area of the East, and so on.

For a checker to reach its kinging rank, it must travel across the board to those squares next to its color band. A White checker, for example, begins its advance from the Black area. It must proceed north until it reaches the kinging squares of the north or the rank of squares next to the White border.

As in traditional checkers, the pieces are placed only on black squares, and therefore, may move only in a diagonal direction. Certain events affect checker play because of the unique shape of the subject board. A White checker moving northward might capture to the northwest or northeast and find itself at the boundary of the neutral zone but three ranks from its kinging squares. It has gone "astray." It cannot move forward and cannot clip the corner. Unlike chess play, when a checker goes astray, it is removed from the board.

Just as in chess play, checker pieces and kings may appear to threaten each other at the corners of a detente board, but they do not. No diagonal move may be made at a corner.

Since there is no king or commander in checker play, another's army cannot be captured. Play either among individuals or between teams continues until all foes are defeated. Detente can be agreed upon between forces of equal power only. Victory, of course, is the elimination of all opposing forces, Having above indicated a preferred embodiment of the present invention, it will occur to those skilled in the art that modifications and alternatives can be practiced within the spirit of the invention. It is accordingly intended to define the scope of the invention only as indicated in the following claims.

I claim:

1. A piece-capture game board having playing pieces adapted to be placed on said board at playing positions in which only one piece can occupy one position at a time, said board having a matrix-type piece position pattern thereon and at least one defined zone including numbers of piece positions and means for distinguishing said zone from the rest of the board so as to differentiate the spaces within said zone from the spaces outside said zone, said zone the being designated in a manner to indicate that pieces within said zone have their originally defined powers altered such that the manner of play of the game is altered for pieces within said zone, said game board having differently colored squares arranged in a chess or checker-board manner, with adjacent squares having a predetermined light/dark pattern and with selected squares being designated as being within said zone, the squares within said defined zone having the same light/dark pattern as squares adjacent said zone, said zone being cruciform in pattern and having arms extending in different directions, the arms of said cruciform pattern being offset and overlapping in a central region.

2. A piece-capture game board having playing pieces adapted to be placed on said board at playing positions in which only one piece can occupy one position at a time, said board having a matrix-type piece position pattern thereon and at least one defined zone including numbers of piece positions, said zone being designated in a manner to indicate that pieces within said zone have their originally defined powers altered such that the manner of play of the game is altered for pieces within said zone, said game board having differently colored squares arranged in a chess or checker-board manner, with adjacent squares having a predetermined light/dark pattern and with selected squares being designated as being within said zone, said squares within said defined zone having the same light/dark pattern as squares adjacent said zone, said board being cruciform and flat in nature and having inner angles at the intersection of the cruciform arms thereof, said inner angles of said cruciform board having indicia only along a portion of the sides of the extending arms substantially only in the plain of the surface of said board so as to indicate the prevention of piece movement across an inner angle of said board.

* * * * *